US008302315B2

(12) United States Patent
Ullmann

(10) Patent No.: US 8,302,315 B2
(45) Date of Patent: Nov. 6, 2012

(54) METHOD FOR OPERATING A HAIR REMOVAL APPARATUS

(75) Inventor: Roland Ullmann, Offenbach (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 13/278,203

(22) Filed: Oct. 21, 2011

(65) Prior Publication Data

US 2012/0030946 A1 Feb. 9, 2012

Related U.S. Application Data

(62) Division of application No. 11/921,825, filed as application No. PCT/EP2006/003857 on Apr. 26, 2006, now Pat. No. 8,069,568.

(30) Foreign Application Priority Data

Jun. 10, 2005 (DE) ..... 10 2005 026 800

(51) Int. Cl.
*B26B 19/28* (2006.01)
*B26B 21/40* (2006.01)

(52) U.S. Cl. ..... 30/45; 30/537

(58) Field of Classification Search ..... 30/29.5, 30/34.05, 34.2, 40.2, 43.4–47, 60, 61, 63, 30/65, 70, 71, 73, 74.1, 77–81, 537; D28/44.1, D28/49, 51, 53; 132/289–292; 606/131, 606/133

See application file for complete search history.

(56) References Cited

U.S. PATENT DOCUMENTS

| | | | |
|---|---|---|---|
| 2,691,216 | A | 10/1954 | Ross |
| 2,787,830 | A | 4/1957 | Argiro |
| 2,803,874 | A | 8/1957 | Obolensky |
| 3,538,604 | A | 11/1970 | Walter et al. |
| 3,552,006 | A | 1/1971 | Baumann et al. |
| 3,581,393 | A | 6/1971 | Yager |
| D286,451 | S | 10/1986 | Ullmann |
| 4,751,781 | A | 6/1988 | Szymansky et al. |
| 4,837,930 | A | 6/1989 | Righi |
| 4,969,266 | A | 11/1990 | Poganitsch |
| D318,539 | S | 7/1991 | Challard |
| 5,058,270 | A | 10/1991 | Deubler et al. |
| D322,334 | S | 12/1991 | Brun |
| 5,193,275 | A | 3/1993 | Hirokazu et al. |
| D334,969 | S | 4/1993 | Gudefin |
| D341,907 | S | 11/1993 | Ullmann |
| D379,012 | S | 4/1997 | Van Asten |
| D400,302 | S | 10/1998 | Ullmann |
| 6,000,135 | A | 12/1999 | Ullmann et al. |
| 6,125,545 | A | 10/2000 | Yamaguchi et al. |

(Continued)

FOREIGN PATENT DOCUMENTS

| | | | |
|---|---|---|---|
| DE | 19633037 | C1 | 5/1997 |

(Continued)

*Primary Examiner* — Jason Daniel Prone

(74) *Attorney, Agent, or Firm* — Kelly L McDow; Kim W Zerby

(57) ABSTRACT

An electric hair removal apparatus includes a housing adapted to be held in the hand, a guard cap mounted on the housing for pivotal movement about a pivot axis, and a control element with which a switch can be activated. The control element is arranged inside an at least locally circular recess of the guard cap. The pivot axis of the guard cap is constructed to be eccentric relative to the recess of the guard cap.

1 Claim, 5 Drawing Sheets

U.S. PATENT DOCUMENTS

| | | | | |
|---|---|---|---|---|
| D439,702 | S | 3/2001 | Sulik | |
| 6,782,625 | B1 | 8/2004 | Wong | |
| 7,002,085 | B2 | 2/2006 | Ullmann et al. | |
| D518,600 | S | 4/2006 | Ullmann et al. | |
| D521,188 | S | 5/2006 | Ullmann et al. | |
| D528,700 | S | 9/2006 | Oh | |
| D537,206 | S | 2/2007 | Ullmann | |
| D580,595 | S | 11/2008 | Mitchell et al. | |
| D592,805 | S | 5/2009 | Refior | |
| D606,260 | S | 12/2009 | Carlucci et al. | |
| 7,937,837 | B2 | 5/2011 | Psimadas et al. | |
| 8,069,568 | B2 * | 12/2011 | Ullmann | 30/45 |
| 2005/0144783 | A1 | 7/2005 | Yiu | |
| 2006/0283019 | A1 | 12/2006 | Oh | |
| 2007/0220752 | A1 | 9/2007 | Psimadas et al. | |
| 2011/0099816 | A1 | 5/2011 | Carlucci | |

FOREIGN PATENT DOCUMENTS

| | | | |
|---|---|---|---|
| EP | 0965419 | | 12/1999 |
| EP | 0825000 | | 8/2000 |
| JP | 59-88190 | A | 5/1984 |
| JP | 2-33746 | | 3/1990 |
| JP | 10076080 | A | 3/1998 |
| WO | WO-2006131171 | A1 | 12/2006 |

* cited by examiner

METHOD FOR OPERATING A HAIR REMOVAL APPARATUS

CROSS REFERENCE TO RELATED APPLICATIONS

This application is a divisional of U.S. patent application Ser. No. 11/921,825, filed Apr. 4, 2008 now U.S. Pat. No. 8,069,568, which claims the benefit of PCT/EP2006/003857, filed Apr. 26, 2006.

TECHNICAL FIELD

This invention relates to an electric hair removal apparatus and a method for operating an electric hair removal apparatus.

BACKGROUND

A hair removal apparatus can be, for example, an epilator apparatus, a hair trimmer or a shaving apparatus. To enable user-friendly usage of the hair removal apparatus, provision can be made for mains-independent operation with batteries or rechargeable batteries. However, this entails the risk, for example when the user takes the hair removal apparatus along on a journey, of the hair removal apparatus being switched on inadvertently and the batteries or rechargeable batteries being discharged. One way to prevent this from happening is to lock the on/off switch of the hair removal apparatus in the off position.

Thus, for example, from EP 0 825 000 B1 there is known a dry shaving apparatus which has a housing with at least one electric drive mechanism for at least one cutter assembly, at least one control switch, and a guard cap for the cutter assembly, which guard cap is pivotally mounted on the housing. The control switch can be activated only in one particular pivot position of the guard cap which releases the cutter assembly. This is achieved, for example, by the control switch being constructed as a switch slide and by a recess being provided in the guard cap to act as a contact travel for at least one control movement of the control switch. The recess is available as a contact travel in only one defined pivot position of the guard cap. No contact travel is available except in this particular pivot position and therefore the control switch cannot be activated.

SUMMARY

In one aspect of the invention, an electric hair removal apparatus includes a housing adapted to be held in the hand, a guard cap mounted on the housing for pivotal movement about a pivot axis, and a control element. The control element is arranged inside an at least locally circular recess of the guard cap and activates a switch. The pivot axis of the guard cap is constructed to be eccentric relative to the recess of the guard cap.

A reliable and robust interlock prevents inadvertent switching on of the hair removal apparatus and therefore, for example, premature discharging of batteries or rechargeable batteries. In this context it is particularly advantageous that an incorrect operation of the hair removal apparatus is practically ruled out and that even a pivotal movement of the guard cap with the hair removal apparatus switched on does not result in any damage but in the hair removal apparatus being switched off gently.

Preferably the movability of the control element is limited by a boundary area surrounding the recess, thus preventing an inadvertent operation of the control element. The control element has preferably a circular outer contour. This enables compactness in design and a flowing movement when pivoting the guard cap. In particular the control element is constructed to include a stepped circular disk. The switch is constructed preferably as a switch slide.

The diameter of the recess is greater than the diameter of the control element preferably by at least a length of contact travel of the control element between two different switch positions of the switch. In addition it is an advantage for the center of the recess to be spaced from the pivot axis of the guard cap by a distance equal to at least half the contact travel. The pivot axis can be arranged between the center of the recess and an end of the guard cap serving to cover a hair removal device. In every pivot position of the guard cap, at least in the switched-off state of the hair removal apparatus, the control element can rest on the boundary area surrounding the recess, contacting it in a circumferential region, or be spaced a constant distance from the boundary area. Furthermore, in the switched-off state of the hair removal apparatus, the control element is arranged preferably concentric with the pivot axis. Through these arrangements, a good coordination of the pivot function of the guard cap and the switch activation using the control element is obtained.

The control element can be arranged in an insert inserted in the guard cap. This is due in particular to production engineering reasons, in addition to permitting selection of an optimum material exhibiting, for example, good sliding properties. The control element and the rotary joint are arranged preferably on opposite main faces of the housing. Sufficient construction space is thus available for both components and complex nesting of the two components can be avoided. In particular with a view to increasing the stability during the pivotal movement of the guard cap it is possible, in the region of the main face opposite the rotary joint, for the housing to have guides for guiding the guard cap during the pivotal movement.

The guard cap is constructed to be preferably U-shaped in cross-section. The hair removal apparatus of the invention is constructed in particular as an electric shaving apparatus.

One aspect of the invention relates furthermore to a method for operating a hair removal apparatus which has a pivotal guard cap for covering a hair removal device and a control element for switching the hair removal apparatus on and off. The control element is locked in a first pivot position of the guard cap and can be activated in a second pivot position of the guard cap. The hair removal apparatus is switched off by the guard cap acting on the control element when, in the switched-on state of the hair removal apparatus, the guard cap is swung from the second pivot position into the first pivot position.

In particular provision can be made for the guard cap to act continuously more intensely on the control element while it is being swung from the second pivot position into the first pivot position. Preferably the guard cap acts on the control element via an eccentric mechanism. It is particularly advantageous for a curved area of the guard cap to act on a curved area of the control element. This enables the pivoting of the guard cap and its acting on the control element to be effected as a flowing, jolt-free movement.

The hair removal device is covered preferably in the first pivot position of the guard cap.

Aspects of the invention, which prevent, reliably and by simple means, the inadvertent operation of an electric hair removal apparatus, will be explained in more detail in the following with reference to the embodiment which is illustrated in the accompanying drawings and relates to an electric shaving apparatus. Embodiments of the invention include electric shaving apparatus as well as other hair removal apparatus such as electric epilators or electric hair trimmers.

DETAILED DESCRIPTION

Figure 1:
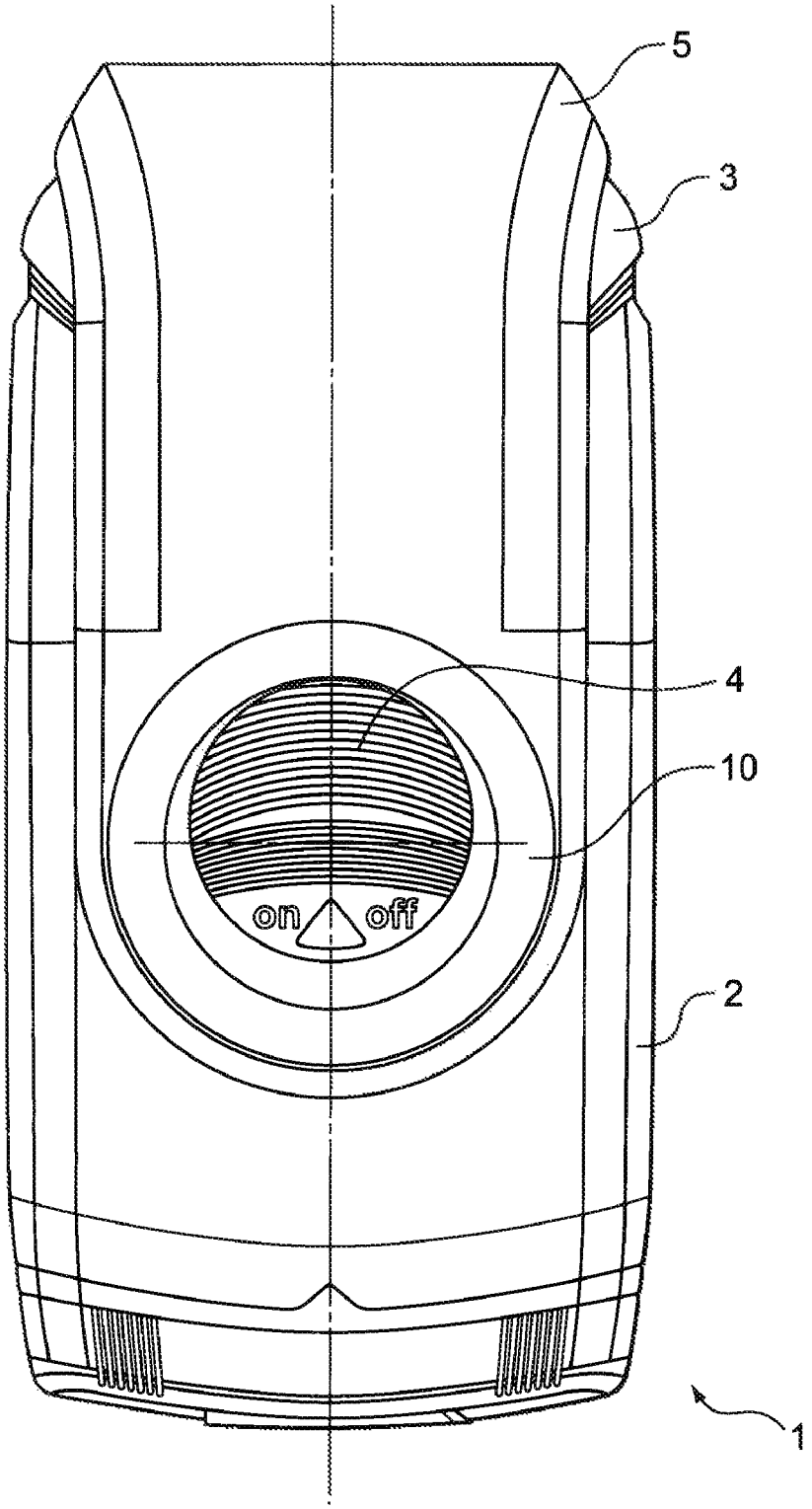
FIG. 1 is a side view of an electric shaving apparatus.
Figure 2:
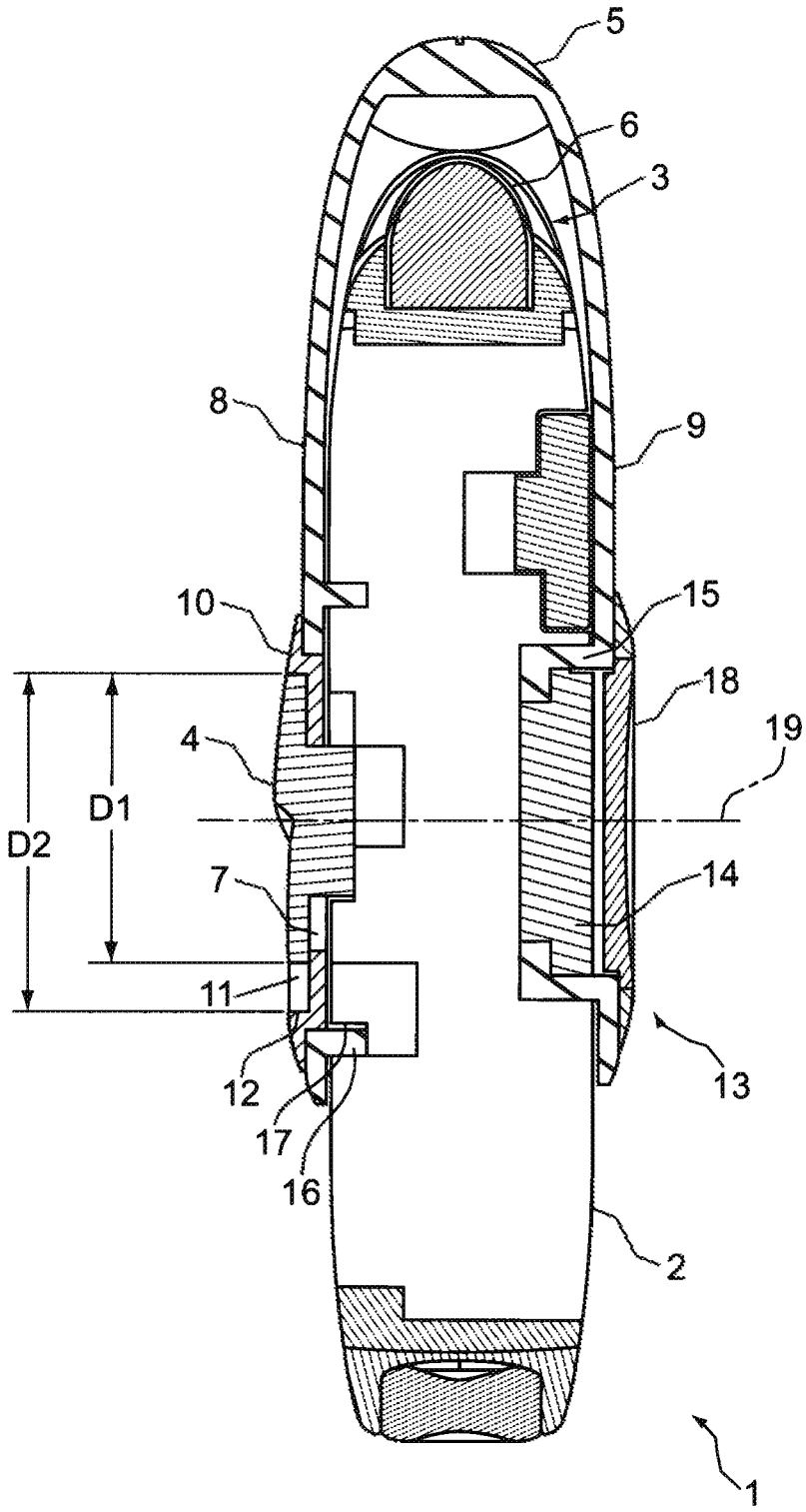
FIG. 2 is a sectional view of the shaving apparatus.

FIG. 1 shows, in a side view, an embodiment of an electric shaving apparatus 1. A related longitudinal section through the center of the shaving apparatus 1 is shown in FIG. 2. The shaving apparatus 1 is in particular a mains-independent device which can be operated with batteries or rechargeable batteries. The shaving apparatus 1 is constructed preferably such that it can easily be taken along on journeys, for example. The inner design of the shaving apparatus 1 is not shown for reasons of clarity. As outer components the shaving apparatus 1 includes in particular a housing 2 which can be held in the hand, a shaving head 3, a control element 4 for activating a switch, not shown in the Figure, and a guard cap 5. Arranged in the shaving head 3 is a cutter assembly 6 which has, for example, a shaving foil and an under cutter and is driven by an electric motor, not shown in the Figure.

The control element 4 has the shape of a stepped circular disk and is arranged on one of the two main sides of the housing 2. The view of FIG. 1 shows this main side. In the region of its maximum radial extension the control element 4 has a cylindrical outer surface 7 with a diameter D1. The switch activatable by the control element 4 is constructed as a switch slide which is aligned parallel to the longitudinal extension of the shaving apparatus 1. The switch is used for switching the shaving apparatus 1 on and off. For this purpose the switch is connected to an electric circuit which supplies electricity to the electric motor for the cutter assembly 6. The position of the control element 4 shown in FIGS. 1 and 2, respectively, corresponds to the switched-off state of the shaving apparatus 1. To switch it on, the control element 4 must be pushed in the direction of the shaving head 3.

The guard cap 5 has a U-shaped configuration in longitudinal section and embraces the two main sides of the housing 2 with a first leg 8 and a second leg 9. The first leg 8 has an annular insert 10 with a recess 11 which is limited in radially outward direction by a cylindrical boundary area 12 of the insert 10. The boundary area 12 has a diameter D2 which is greater than the diameter D1 of the outer surface 7 of the control element 4. In the recess 11 the control element 4 is arranged such that the outer surface 7 of the control element 4 is adjacent to the boundary area 12 of the insert 10. With regard to its lateral position, the control element 4 is arranged eccentrically in the recess 11 such that the radial distance between the outer surface 7 of the control element 4 and the boundary area 12 of the insert 10 varies over the circumference. According to the representation of FIGS. 1 and 2 the control element 4 rests, on its side close to the shaving head 3, with its outer surface 7 on the boundary area 12 of the insert 10, hence the control element 4 cannot be displaced any further in the direction of the shaving head 3 and therefore the shaving apparatus 1 cannot be switched on.

A rotary joint 13 is provided in the region of the second leg 9 of the guard cap 5 by a journal 14, which is connected to the housing 2, and a sleeve 15, which is integrally formed on the second leg 9 of the guard cap 5 and pushed onto the journal 14. The journal 14 and the sleeve 15 also engage each other radially, thereby locating the guard cap 5 pivotally on the housing 2. Formed on the first leg 8 of the guard cap 5 are projections 16 which engage in grooves 17 in the housing 2 and effect an additional guidance of the guard cap 5 during a pivotal movement. The rotary joint 13 is covered by a cover plate 18. A pivot axis 19 oriented perpendicular to the two main sides of the housing 2 is defined by the rotary joint 13. In this arrangement the rotary joint 13 is constructed such that the boundary area 12 of the insert 10 extends eccentrically to the pivot axis 19. The outer surface 7 of the control element 4 extends concentric with the pivot axis 19. As a result, the position of the boundary area 12 of the insert 10 relative to the outer surface 7 of the control element 4 is changed while the guard cap 5 is being pivoted about the pivot axis 19. In particular it is possible by pivoting the guard cap 5 to move the boundary area 12 of the insert 10 on the side of the control element 4 close to the shaving head 3 far enough from the outer surface 7 of the control element 4 so that the shaving apparatus 1 can be switched on by moving the control element 4 in the direction of the shaving head 3. This is explained in more detail with reference to FIGS. 4 to 6, where in each case the guard cap 5 adopts a different pivot position than in FIGS. 1 and 2. The pivot position of the guard cap 5 shown in FIGS. 1 and 2, in which the shaving head 3 is covered by the guard cap 5 and thereby protected from outer mechanical actions and in which it is impossible to switch on the shaving apparatus 1, is designated as the rest position.

Figure 3:
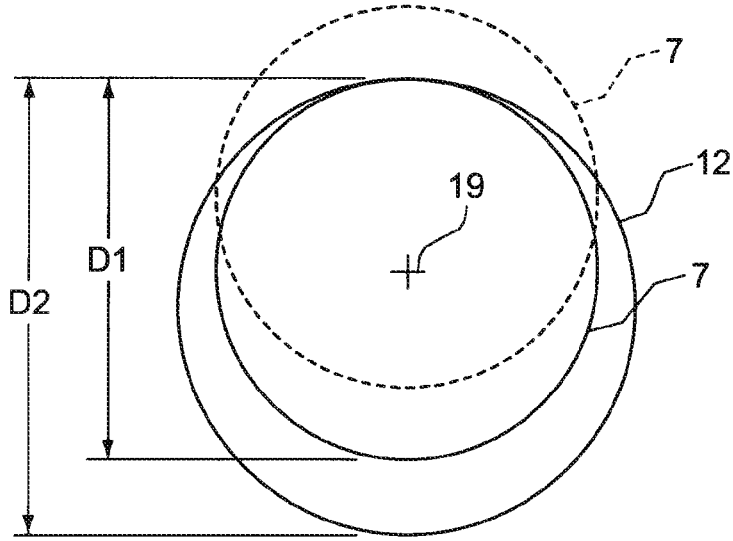
FIG. 3 is a schematic view of the rest position occupied by the guard cap in FIGS. 1 and 2.

FIG. 3 shows a schematic representation of the rest position which the guard cap 5 occupies in FIGS. 1 and 2. The way of representation corresponds to a highly abstracted side view in which only the contour of the boundary area 12 of the insert 10 of the guard cap 5, the contour of the outer surface 7 of the control element 4 and the pivot axis 19 are drawn. The contour of the outer surface 7 of the control element 4 is presented in the position which corresponds to the switched-off state of the shaving apparatus 1 as well as in the position which corresponds to the switched-on state of the shaving apparatus 1. To differentiate between the two positions, the contour for the switched-off state is a continuous line and for the switched-on state a dashed line.

FIG. 3 shows clearly the eccentric arrangement of the boundary area 12 of the insert 10 relative to the pivot axis 19 and, in the switched off state of the shaving apparatus, the concentric arrangement of the outer surface 7 of the control element 4 relative to the pivot axis 19. Furthermore it becomes apparent from FIG. 3 that it is impossible to switch on the shaving apparatus 1 in the illustrated pivot position of the guard cap 5 because the dashed circle representing the outer surface 7 of the control element 4 in the switched-on state of the shaving apparatus 1 extends in part radially outside the boundary area 12 of the insert 10. In actual fact, however, the freedom of movement of the control element 4 is limited to the region radially inside the boundary area 12 so that the boundary area 12 has to be displaced by pivoting the guard cap 5 in order to be able to switch on the shaving apparatus 1 with the control element 4.

Figure 4:
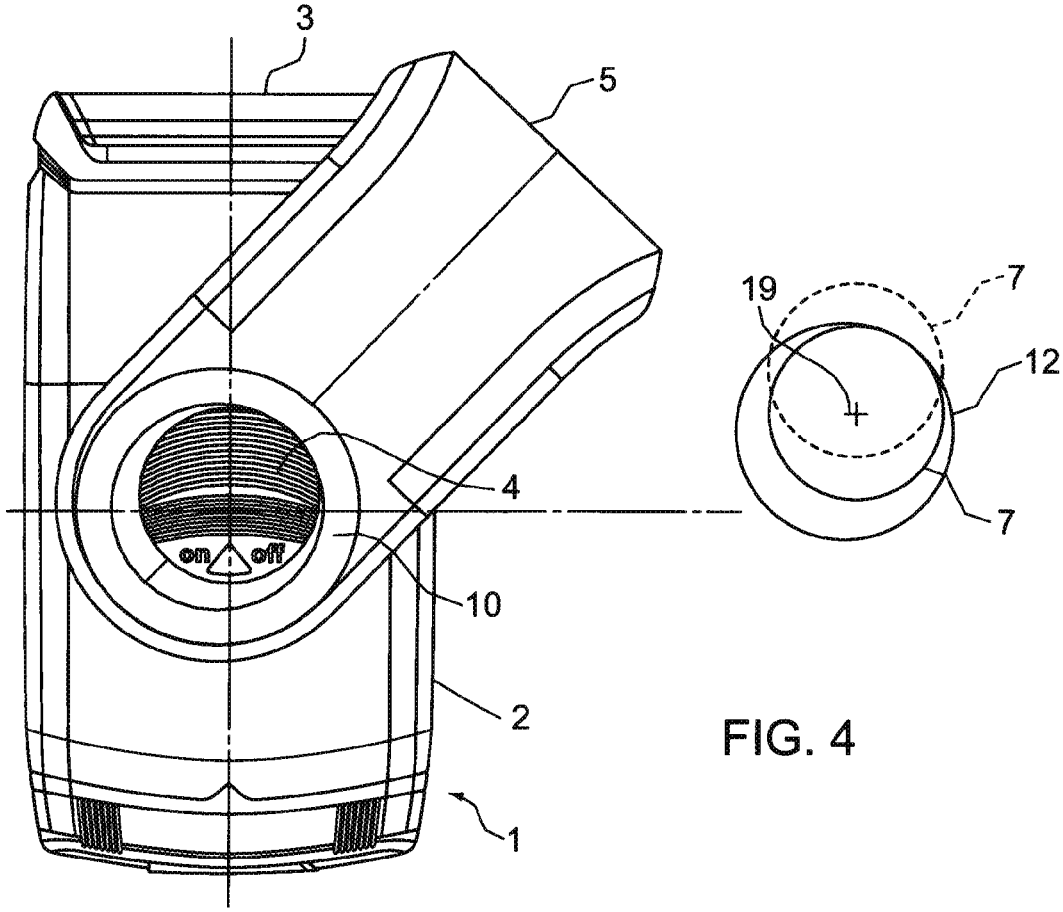
FIG. 4 is a side view of the shaving apparatus with the guard cap in an intermediate position.

FIG. 4 shows, in a side view, the shaving apparatus 1 with the guard cap 5 in an intermediate position. Also shown in FIG. 4 is the pivot position of the guard cap 5 in a representation corresponding to FIG. 3. The guard cap 5 is swung out of the rest position shown in FIGS. 1 to 3 by a pivotal movement about the pivot axis 19 in clockwise direction so that the guard cap 5 projects sideways beyond the housing 2 of the shaving apparatus 1. As becomes apparent from the schematic representation of the pivot position, the boundary area 12 of the insert 10 is displaced in the course of the pivotal movement in accordance with an eccentric movement about the pivot axis 19 and thus moves, on the side of the control element 4 close to the shaving head 3, increasingly away from the outer surface 7 of the control element 4. However, switching on the shaving apparatus 1 continues to be impossible. At most the control element 4 can be moved slightly in the direction of the shaving head 3, whereby the position of the control element 4 required for switching on the shaving apparatus 1 is still not reached because the outer surface 7 of the control element 4 in this position finds itself in part radially outside the boundary area 12 of the insert 10. Therefore, the guard cap 5 is swung further in clockwise direction until the pivot position shown in FIG. 5 is reached.

Figure 5:
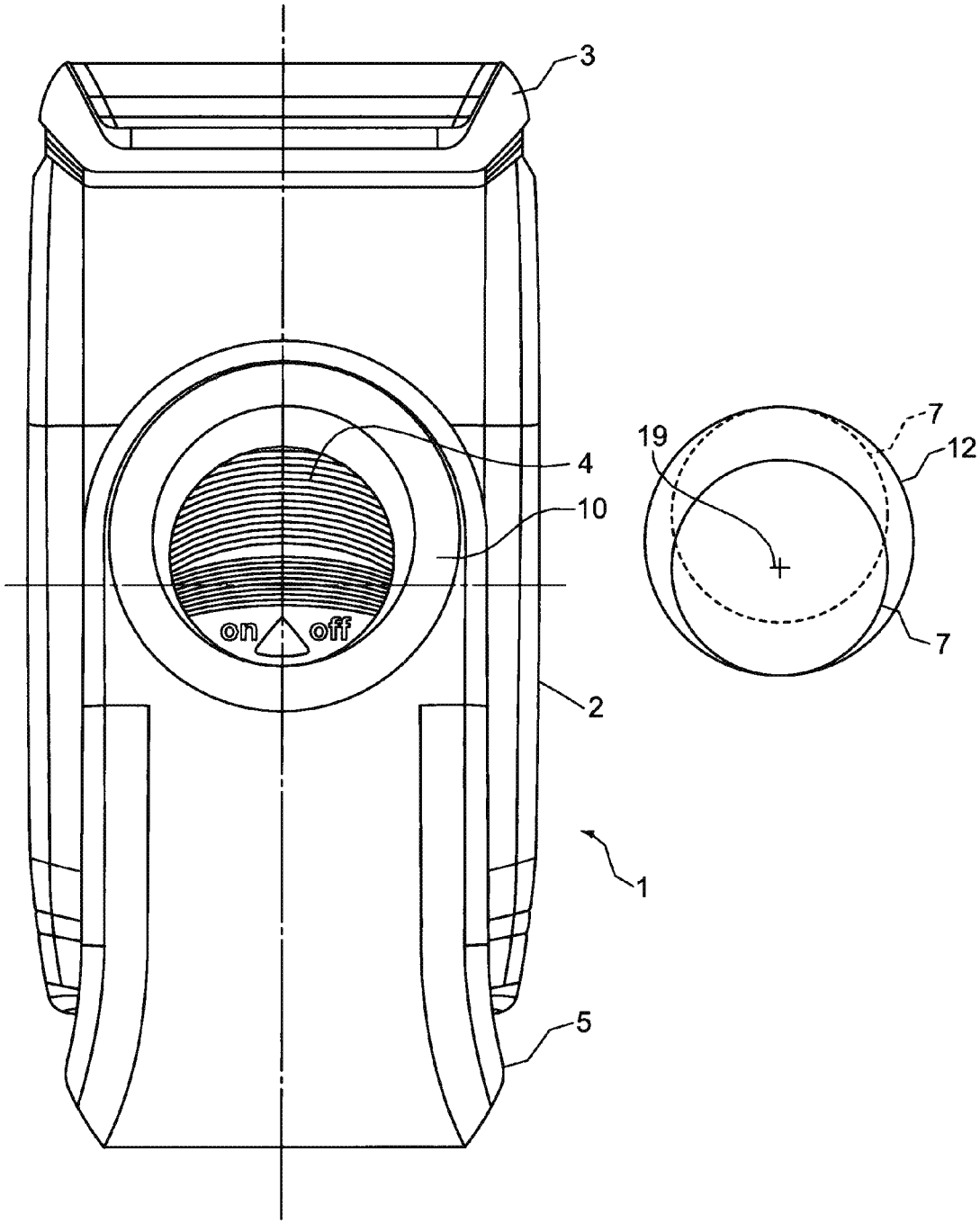
FIG. 5 is a side view of the shaving apparatus with the guard cap in an operating position.
Figure 6:
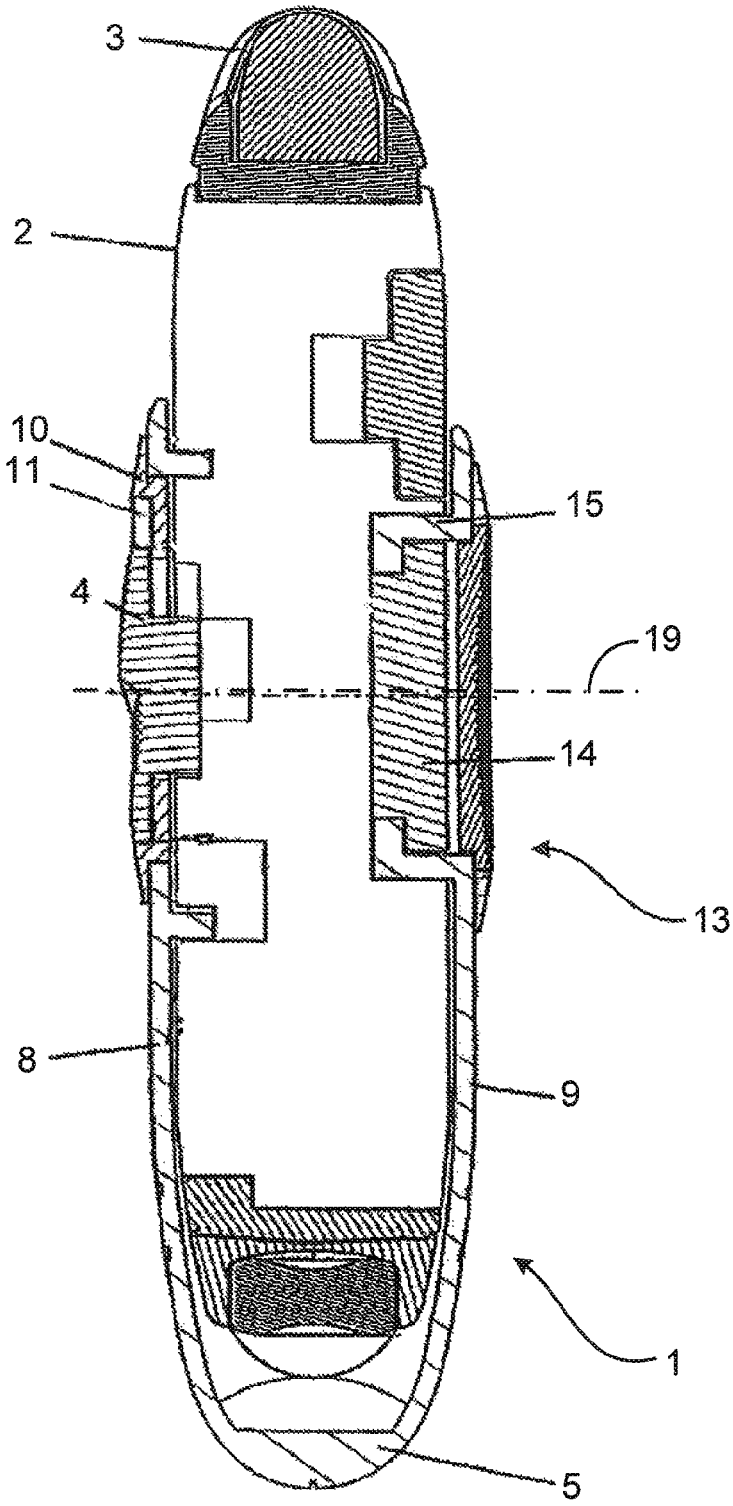
FIG. 6 is a sectional view of the shaving apparatus with the guard cap in the operating position.

FIG. 5 shows, in a side view, the shaving apparatus 1 with the guard cap 5 in an operating position. Also shown is the pivot position of the guard cap 5 in a representation again similar to FIG. 3. FIG. 6 shows a related longitudinal section of the shaving apparatus 1. In the operating position, the guard cap 5 is pivoted through an angle of 180° relative to the rest position and projects beyond the housing 2 at the end of the shaving apparatus 1 opposite the shaving head 3. As the result of this projection, the area available for holding the shaving apparatus 1 is enlarged, thereby facilitating the handling of the shaving apparatus. In addition, the guard cap 5 fully exposes the shaving head 3 in the operating position so that the shaving head 3 is accessible for performing a shave. As becomes also apparent in particular from the representation of the pivot position of the guard cap 5, it is possible in the operating position for the control element 4 to be moved far enough in the direction of the shaving head 3 for the shaving apparatus 1 to be switched on. The outer surface 7 of the control element 4 lies radially inside the boundary area 12 of the insert 10 in both the switched-off and the switched-on state of the shaving apparatus 1.

On completion of the shave, the shaving apparatus 1 is switched off by moving the control element 4 away from the shaving head 3. Then the guard cap 5 is swung back into the rest position in order to protect the shaving head 3 and prevent the shaving apparatus 1 from being switched on inadvertently. Swinging the guard cap 5 back into the rest position is even then possible when the shaving apparatus 1 is not switched off first. In this case the eccentric movement of the boundary area 12 of the insert 10 caused by the pivotal movement of the guard cap 5 results in the boundary area 7 being pressed in a continuous movement increasingly against the outer surface 7 of the control element 4, thereby moving the control element 4 in a direction away from the shaving head 3. This results ultimately in the shaving apparatus 1 being switched off due to the pivotal movement of the guard cap 5. Hence in this case too the shaving apparatus 1 is guaranteed to be switched off when the guard cap 5 is in the rest position. The switching off of the shaving apparatus 1 by swinging the guard cap 5 back into the rest position takes place in a flowing movement and has no detrimental effect on the shaving apparatus 1.

To ensure optimum functionality of the eccentric mechanism, the diameter D1 of the outer surface 7 of the control element 4, the diameter D2 of the boundary area 12 of the insert 10 and the length of contact travel over which the control element 4 has to be moved for switching the shaving apparatus 1 on or off are coordinated with each other. Such coordination entails arranging for the difference between the diameters D2 and D1 to equal at least the length of the contact travel. Preferably the difference between the diameters D2 and D1 is selected such that it equals the contact travel in order to optimize as far as possible the switching off of the shaving apparatus 1 by swinging the guard cap 5 back into the rest position.

Also important is the magnitude of the eccentricity, i.e., the distance between the pivot axis 19 and the center of the boundary area 12 of the insert 10. This distance is selected preferably to be half the size of the contact travel. This means that for a pivotal movement of the guard cap 5 through an angle of 180° from the rest position in which the control element 4 is blocked, the control element 4 is allowed a freedom of movement equal to the contact travel. A smaller eccentricity is not sufficient to enable the shaving apparatus 1 to be switched on. A larger eccentricity is not required and results in an unfavorable utilization of the available space.

The geometry described results in the outer surface 7 of the control element 4 and the boundary area 12 of the insert 10 contacting each other in a small circumferential region or in them being spaced a very small and constant distance from each other. This circumferential region follows the pivotal movement and finds itself in each case on the side of the control element 4 close to the end of the guard cap 5 connecting the two legs 8 and 9. When the shaving apparatus 1 is switched on in the operating position of the guard cap 5, the contact or the small distance between the outer surface 7 of the control element 4 and the boundary area 12 of the insert 10 switches to the diametrically opposite circumferential region.

What is claimed is:

1. A method for operating a hair removal apparatus, comprising:

pivoting a guard cap covering a hair removal head of the apparatus from a first pivot position to a second pivot position to unlock a control element;

after the control element is unlocked, manually moving the control element to switch the hair removal apparatus on; and pivoting the guard cap from the second pivot position to the first pivot position, thereby cooperating with the control element to switch the hair removal apparatus off; and wherein during the pivoting, the guard cap pivots about a pivot axis and defines an at least locally circular recess within which the control element is disposed.

* * * * *